US007650968B2

(12) United States Patent
Oesterle et al.

(10) Patent No.: US 7,650,968 B2
(45) Date of Patent: Jan. 26, 2010

(54) ELEVATOR RESCUE OPERATION CONTROL SYSTEM INCLUDING SELECTIVE TRANSFORMER WINDING ENERGIZATION

(75) Inventors: Robert Oesterle, Berlin (DE); Marvin Dehmlow, Berlin (DE); Axel Friedrich, Berlin (DE)

(73) Assignee: Otis Elevator Company, Farmington, CT (US)

( * ) Notice: Subject to any disclaimer, the term of this patent is extended or adjusted under 35 U.S.C. 154(b) by 418 days.

(21) Appl. No.: 11/577,876

(22) PCT Filed: Dec. 31, 2004

(86) PCT No.: PCT/EP2004/014875

§ 371 (c)(1),
(2), (4) Date: Apr. 25, 2007

(87) PCT Pub. No.: WO2006/069591

PCT Pub. Date: Jul. 6, 2006

(65) Prior Publication Data

US 2009/0127029 A1 May 21, 2009

(51) Int. Cl.
*B66B 1/06* (2006.01)

(52) U.S. Cl. ..... 187/290; 187/393

(58) Field of Classification Search ..... 187/277, 187/278, 293, 296, 290, 391, 393
See application file for complete search history.

(56) References Cited

U.S. PATENT DOCUMENTS 3,706,357 A * 12/1972 Simpson ..... 187/290
4,516,665 A * 5/1985 Watanabe ..... 187/296
4,666,020 A * 5/1987 Watanabe ..... 187/290
5,058,710 A 10/1991 Iwasa
5,285,029 A * 2/1994 Araki ..... 187/290
5,698,823 A * 12/1997 Tanahashi ..... 187/296
5,864,474 A 1/1999 Jang
5,893,432 A * 4/1999 Nguyen et al. ..... 187/290
6,315,081 B1 * 11/2001 Yeo ..... 187/290
7,275,622 B2 * 10/2007 Hall et al. ..... 187/290
2004/0020726 A1 2/2004 Chen

FOREIGN PATENT DOCUMENTS

JP 07242376 9/1995

OTHER PUBLICATIONS

PCT International Search Report and Written Opinion for International Application No. PCT/EP2004/014875 mailed Nov. 15, 2005.

* cited by examiner

*Primary Examiner*—Jonathan Salata
(74) *Attorney, Agent, or Firm*—Carlson, Gaskey & Olds PC

(57) ABSTRACT

A power supply for an elevator drive includes a voltage input, a comparator for comparing the input voltage with a predetermined threshold, a transformer having a primary winding and a secondary winding connected to the elevator drive. The transformer has a single tapped primary winding. When the input voltage exceeds the predetermined threshold input, the comparator output causes power to be supplied to the primary winding via one of an end of the winding or the tapping of the winding, and when the input voltage is below the predetermined threshold, input power is supplied to the primary winding via the other of the end of the primary winding and the tapping of the winding.

5 Claims, 1 Drawing Sheet

ELEVATOR RESCUE OPERATION CONTROL SYSTEM INCLUDING SELECTIVE TRANSFORMER WINDING ENERGIZATION

The present invention relates to a system for controlling operation of an elevator in a rescue operation in the event of a power failure.

BACKGROUND

If the mains power supplying an elevator fails, the elevator will stop running. If the elevator is between floors, the passengers are unable to get out of the elevator and this can cause impatience and anxiety. Most elevators are provided with an alarm button inside or outside the elevator cab which can be pressed by passengers trapped in the elevator or people outside the elevator. This may cause an alarm to sound outside the elevator to alert help and/or may be connected, by telecommunication, to a help center so that the trapped passengers can communicate with someone outside of the elevator and call for help. The alarm button will have its own power supply e.g. a battery so that it remains in action even when the mains power fails.

To avoid passengers being trapped in an elevator for any length of time, many modern elevators are now provided with a back up power supply in the form of a battery or accumulator which is switched on either automatically or by pressing a button within the elevator in the event of a mains power failure. The power from the battery is sufficient for the elevator controller to be able to bring the elevator to the nearest floor. When the elevator arrives at the floor the doors can be opened and the passengers can exit the elevator.

Most elevators comprise an elevator car suspended in a hoistway or shaft on steel ropes or cables which run over a pulley at the top of the shaft and which are attached at the other end to a counterweight. A main motor is provided to drive the elevator car in accordance with instructions from an elevator controller.

In the event of a mains power failure, the motor ceases running and the brake is applied to prevent the elevator falling to the bottom of the hoistway or being shot up the hoistway as the counterweight falls. This will result, in many cases, in the elevator being suddenly brought to a stop between floors.

In some elevators, a rescue mechanism allows the brake to be released by providing power from an emergency power supply such as a battery to the controller. Depending on the relative weights of the elevator car and the counterweight the car will either move up or down until it reaches the next floor. A sensor will detect when the elevator reaches the floor and will re-apply the brake and the doors can be opened to let the passengers out.

US Patent Publication No. 20040020726 discloses such an emergency operation. When the car is trapped between floors, the passengers press an emergency button which releases the brake allowing the car to move to the next floor.

U.S. Pat. No. 6,264,005 also teaches such a system in which the actual speed of the car in moving to the next floor is not (as in US 2004002726) merely dependent on the difference in weight between the car (which is dependent on the passenger load) and the counterweight. In this patent, the rescue operation during power failure is controlled by controlling a speed and torque of a permanent magnet type synchronous motor with its electricity generating power.

Both systems do, however, rely on an imbalance between the car and the counterweight to bring the elevator to the next floor in the case of a car stopping between floors due to power failure. This means that the rescue operation will not work where there is no load imbalance. Furthermore, the elevator will only be able to move in one direction (depending on the relative weights of the car and the counterweight) and will not necessarily move to the nearest floor. If the rescue operation is also to work where there is no load imbalance drive support is required—i.e. a drive powered by the emergency power supply must be able to drive the elevator to the next floor.

In all systems with a rescue operation, circuitry is provided which allows the parts of the system needed to implement the rescue operation to be supplied with power from an emergency power supply in the event of mains power failure. The emergency power supply is usually a battery or accumulator. The circuitry thus usually includes a switched mode power supply for switching from mains power to battery power.

Most such systems use an uninterruptible power supply powered by batteries or an emergency generator. In the event of a mains power failure, these devices will generate the same voltage level as was provided by the mains supply.

Such arrangements are large and expensive, and require fairly complex circuitry and relatively large components requiring more board space and more connections. There is, therefore, a need for a simple, effective switched mode power supply circuit which allows power supply to a drive circuit for an elevator to switch easily from mains power to battery power in, e.g. the event of a power failure so that the elevator can be driven to the next floor.

SUMMARY

Accordingly, the invention comprises a power supply for an elevator drive, comprising a voltage input, a comparator for comparing the input voltage with a predetermined threshold, a transformer having a primary winding and a secondary winding connected to the elevator drive; where the transformer has a single tapped primary winding and wherein, when the input voltage exceeds the predetermined threshold input, the comparator output causes power to be supplied to the primary winding via one of an end of the winding or the tapping of the winding, and when the input voltage is below the predetermined threshold, input power is supplied to the primary winding via the other of the end of the primary winding and the tapping of the winding.

Although the present invention can operate over a wide voltage range and switch between the two SMPS stages for any preselected drop in voltage, preferably, the voltage input comprises a mains power supply and a battery, connected to the comparator input. When the mains power supply is functioning, the comparator outputs a signal indicating that the input voltage exceeds the predetermined threshold. In the event of a mains power failure, the input voltage to the comparator is from the battery and this is less than the predetermined threshold.

Whilst, in theory, the invention would work if both the mains and the battery were permanently connected to the comparator, this clearly involves undesired continuous use of the battery. Thus, in a preferred embodiment the battery is connected to the comparator via a switch which is normally open and closes when the mains power fails or falls below a given value. The battery switch could be closed automatically or manually by means of a passenger or a person outside the elevator pressing a button.

Thus, the present invention provides a two stage SMPS for an elevator drive—one stage is active during normal mains operation—the other one can be activated when the drive is battery powered. The single SMPS transformer needs only a single tapped primary coil. The battery voltage can be switched to the drive input and the SMPS itself will decide which control stage has to be activated.

Preferred embodiments of the invention will now be described, by way of example only, with reference to the accompanying drawings.

DETAILED DESCRIPTION

Figure 1:
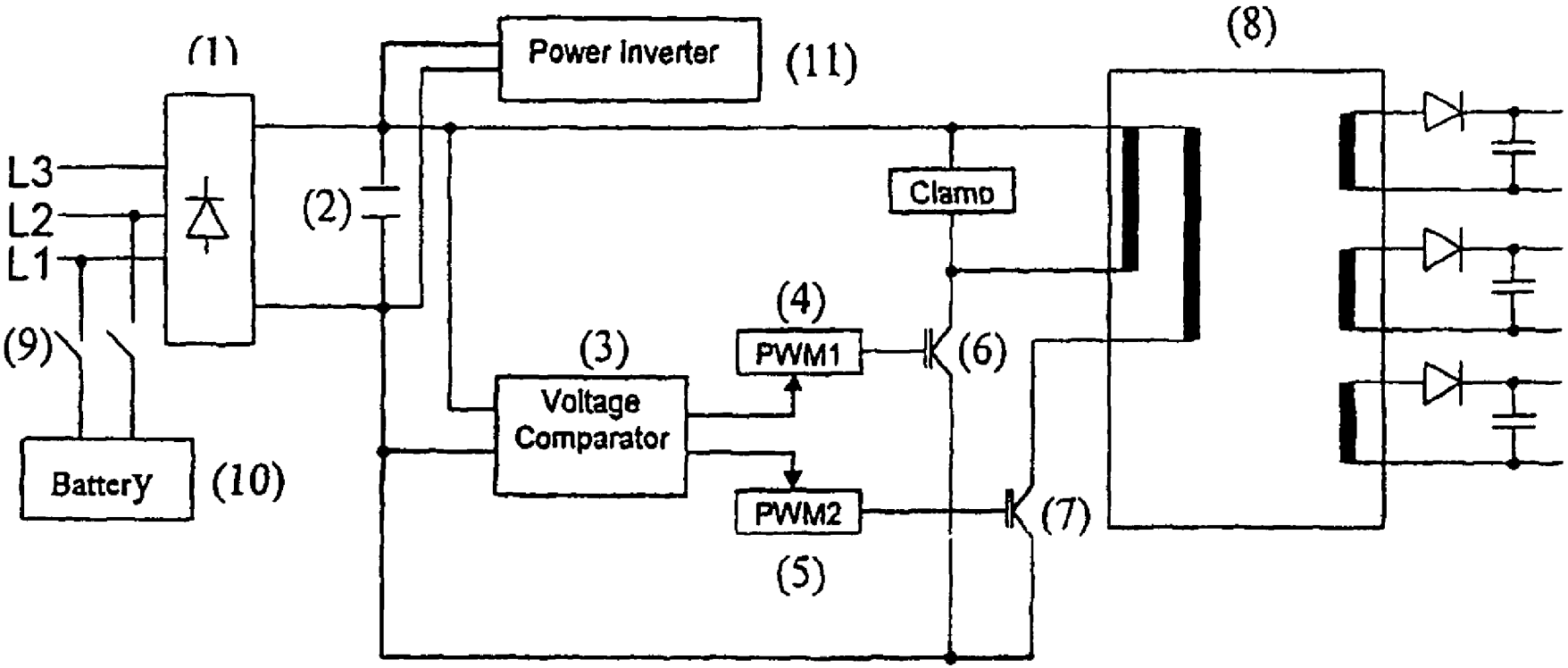
FIG. 1 shows an example of a switched mode power supply according to the present invention.

The drive SMPS consists of a rectifier 1, a DC link capacitor 2, a control circuit and a transformer 8 having a single, tapped primary winding. The drive circuitry to be powered by the SMPS is connected to the transformer output. The power inverter 11 for the motor control is connected to the rectifier and the DC link capacitor.

The control circuit comprises a comparator 3 receiving power input signals and comparing the input signal with a predetermined threshold value. The control circuit also comprises first 4 and second 5 pulse width modulator units (PWM) connected to the output of the comparator. The PWM are connected to control respective first 6 and second 7 power switches. The first power switch is connected to one end of the primary winding. The second power switch is connected to the other end of the primary winding.

Under normal operation the drive circuitry is powered by the mains power i.e. the SMPS is a mains supplied SMPS. The voltage comparator 3 recognises that the input to it is mains power input and outputs a signal to enable the first PWM unit 4 which controls the first power switch 6. The second PWM 5 is disabled. The first power switch is connected to one end of the tapped primary winding. The tapping of the primary winding is connected to the positive rectified input voltage so that there is a direct connection to the rectifier and to the DC link capacitor.

If the input voltage to the comparator falls below a given threshold e.g. due to mains power failure, the comparator outputs a signal which disables the first PWM 4 and enables the second PWM 5. The second PWM thus starts to control the second power switch 7 which is connected to the opposite end of the primary winding to that to which the first switch is connected.

In the case of a mains power failure the small DC link capacitor 2 discharges very quickly. The battery 10 can then be switched to the input of the drive SMPS i.e. to the input of the comparator by a contact 9. This could be actuated automatically or manually e.g. by a passenger pressing an emergency button inside the elevator, or by someone pressing an emergency button located outside the elevator, e.g. in the controller cabinet.

When mains power is restored the battery contact opens and the voltage comparator detects the higher mains voltage and enables the first PWM.

Thus, the two stage SMPS of the present invention works over a wide range of input voltages, which cannot be achieved by a transformer with only a single, simple winding. At low input voltages, a huge de-rating of the transformer output power would be necessary-however, this is not acceptable for a SMPS design. Furthermore compared to previous systems, fewer mechanical contacts are required for the battery and the transformer is much simpler and smaller. Compared to prior systems, the SMPS requires less board spaced and is simpler and, thus less expensive to manufacture. Also the arrangement of a prior system requires an additional connector for the transformer in the battery supply mode.

Thus, the arrangement of the present invention maintains the operating advantages of a circuit with two transformers whilst providing a simple, compact and less expensive design which operates over a wide range of input voltages.

The invention claimed is:

1. A power supply for an elevator drive, comprising a voltage input, a comparator for comparing the input voltage with a predetermined threshold, a transformer having a single tapped primary winding and a secondary winding, the secondary winding being connected to the elevator drive;

wherein, when the input voltage exceeds the predetermined threshold input, an output of the comparator is configured to cause power to flow between the tapping of the primary winding and a first end of the primary winding, and wherein, when the input voltage is below the predetermined threshold, the output of the comparator is configured to cause power to flow between the tapping of the primary winding and a second end of the primary winding.

2. The power supply of claim 1, wherein the voltage input comprises a mains power supply and a battery, connected to the comparator input, wherein, when the mains power supply is functioning, the comparator outputs a signal indicating that the input voltage exceeds the predetermined threshold, and in the event of a mains power failure, the input voltage to the comparator is from the battery and this is less than the predetermined threshold.

3. The power supply of claim 1, wherein the battery is connected to the comparator via a switch which is normally open and closes when the mains power fails or falls below a given value.

4. The power supply of claim 3, wherein the switch closes automatically when the mains power fails or falls below a given value.

5. The power supply of claim 3, wherein the switch is adapted to be closed manually by means of pressing a button.

* * * * *